United States Patent [19]

Pierce, Jr.

[11] 4,023,837

[45] May 17, 1977

[54] TWINE CATCHER AND KNIFE TRAP ASSEMBLY FOR PACKAGE TYING MACHINE

[75] Inventor: Paul Pierce, Jr., La Grange, Ill.

[73] Assignee: B. H. Bunn Company, Alsip, Ill.

[22] Filed: Sept. 3, 1976

[21] Appl. No.: 720,263

[52] U.S. Cl. ..... 289/13

[51] Int. Cl.[2] ..... B65H 69/04

[58] Field of Search ..... 289/2, 10, 13, 14, 15, 289/16

[56] References Cited

UNITED STATES PATENTS

| | | | |
|---|---|---|---|
| 2,182,959 | 12/1939 | Bunn | 289/2 |
| 3,708,190 | 1/1973 | Beedy | 289/13 |
| 3,722,934 | 3/1973 | Nolt et al. | 289/13 |

*Primary Examiner*—Louis K. Rimrodt

[57] ABSTRACT

The operation of the twine catcher and knife trap assembly for a package tying machine is improved by providing a specially configured operating hole in the support structure associated with the stringholder button to control the self-camming action of the button whereby the button is prevented from excessively clamping the associated tie material during the tying machine's knotting cycle yet able to provide a desired clamping action during the machine's wrapping cycle. The cutter and pull out elements on a tying machine's knife trap assembly are displaced relative to one another so as to sequentially effect the tie material dislodgement and severing operations thereby preventing any premature pull out and resultant misties.

5 Claims, 6 Drawing Figures

Fig 3
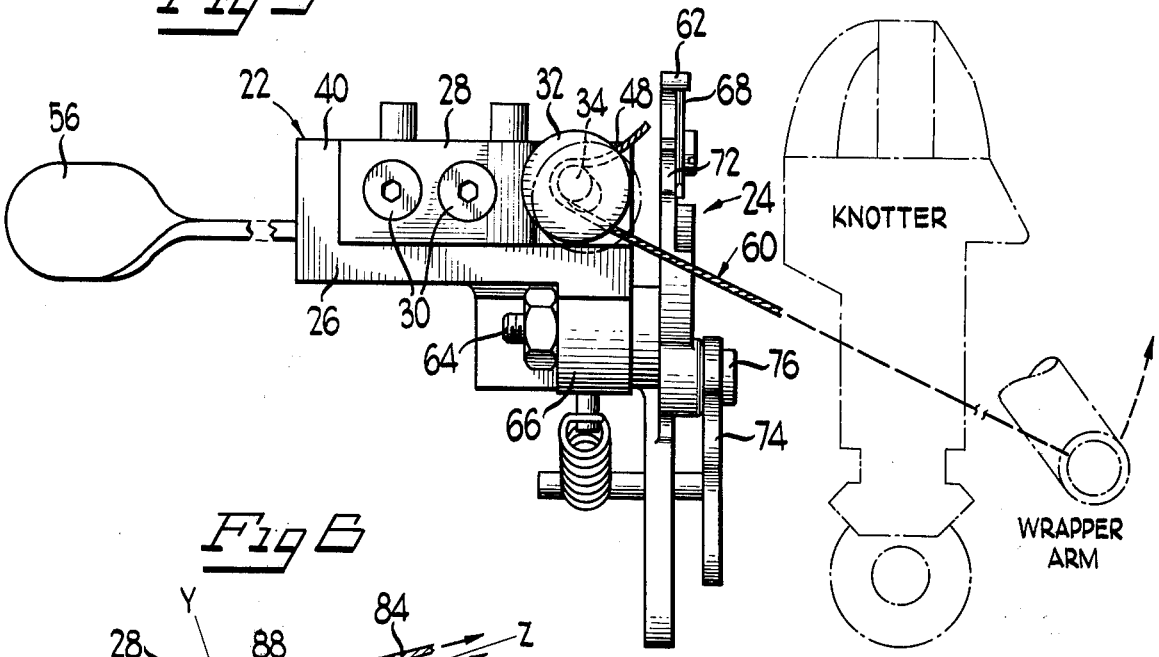
Fig 6
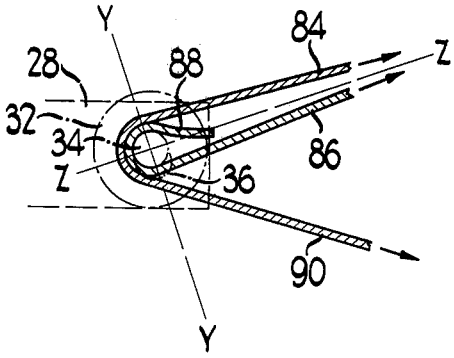
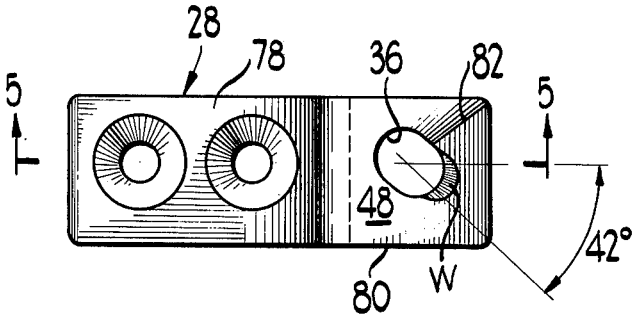
Fig 4
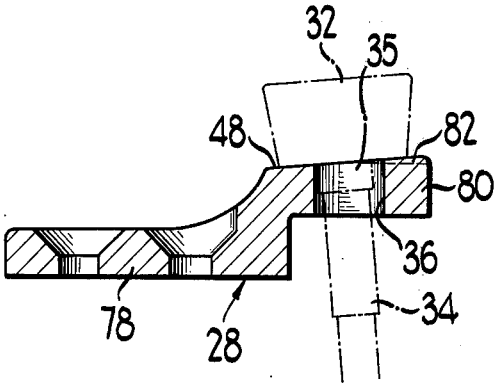
Fig 5

TWINE CATCHER AND KNIFE TRAP ASSEMBLY FOR PACKAGE TYING MACHINE

BACKGROUND OF THE INVENTION

1. Field of the Invention

The invention relates to package tying machines and more particularly relates to twine catchers and knife trap assemblies for package tying machines.

2. Description of the Prior Art

Tying machines for bundles and other packages are designed with minimal modification, to accommodate both natural fiber twine and synthetic tie materials. The twine is threaded from a twine cone through a rotatably twine arm, and then fastened to a twine catcher located below the tying machine's table adjacent the knotting mechanism thereof. During a tying cycle, the end of the twine is held by the twine catcher and the twine arm is accelerated almost instantly from a standstill to the rotational speed of the drive for the arm to wrap the twine about the bundle to be tied. An additional portion of the twine is then held by the twine catcher while the knot is being formed. It will be understood then that the twine catcher of the so-called stringholder assembly is the spring-biased button which holds the free or tail end of the twine during the wrapping cycle and while the knot is being formed, and which also retains the future second end of the twine after the wrapping cycle has been completed and while the knot is being formed.

For purposes of the present invention, familiarity with package tying machines is presumed and reference is made to U.S. Pat. No. 1,606,290 for a detailed description of the operational cooperation of the various component parts of a package tying machine; and to U.S. Pat. No. 3,708,190 for a detailed description of a dual-tension stringholder assembly for package tying machines. Reference is also directed to U.S. Pat. No. 2,274,525 — over which patent the present invention is an improvement — for a detailed description of the configuration of a typical stringholder assembly.

The problem of misties, i.e., incomplete or completely missed knots, has long plagued package tying machine operations. Oftentimes during the continuous use of a tying machine, peelings and chaff from the tie material — whether the latter be cotton or synthetic twine, plastic tape, or other type material — will build up behind the stringholder button to such an extent that the desired clamping action of the stringholder mechanism, and the resultant tensioning of the tie material, is greatly diminished. This in turn will result in misties or even sometimes allow the clamped end of the tie material to completely fall out.

The above-noted peeling buildup problem occurs primarily because the prior art stringholders are allowed to oscillate and pivot over, i.e., self-cam, to any of various offset clamping positions as the direction of pull of the tie material varies. Thus, the prior art stringholder buttons can desirably cant over — while clamping down forcefully against the associated tie material and the bearing face of the stringholder's support structure — in the direction that the tie material assumes during the completion of the tying machine's wrapping cycle. However, the button can also undesirably cant over in the direction the tie material assumes during the machine's knotting and pull out cycles and thereby effect excessive clamping forces tending to lock the tie material in place and thus to inhibit the last-mentioned cycles. This excessive clamping action also tends to strip off tie material filaments thereby causing chaff to build up which in turn increases the occurrence of misties, requires systematic stringholder clean up, and necessitates machine down time. For purposes of describing this invention, the specific tie material in question will be cotton twine. However, it is to be understood that any of the above-noted types of tie materials can be utilized.

Test experiments have shown that with prior art stringholders misties occur at the approximate rate of 1 mistie in every 100 tying cycles. However, utilization of the present invention has achieved test results of only 1 mistie per several thousand tying cycles for smaller diameter twines. One specific test ran through approximately 38,000 tying cycles before a mistie occurred.

Additionally, it is to be noted that misties can occur from what is termed premature pull out, i.e., when the clamped end of the twine is completely or partially pulled out of the stringholder before either the machine's wrapping or knotting cycles is completed. This problem is especially prevalent with the plastic tape type of tie materials. Such premature pull out can occur from either the above-noted chaff buildup with attendant diminished clamping power in the stringholder, or from the early severing and then partial pull out of the newly clamped twine end as the previously clamped twine end is properly dislodged by the action of the knife trap assembly; the latter action is discussed in detail later herein.

Another rather significant problem with prior art stringholder mechanisms is the fact that several different stringholder set-ups — with different hand-filed configurations, surface finishes, and associated spring members — were required to accommodate the various types, weights, and sizes of natural and synthetic tie materials being utilized by package tying machine users. In recent times, as many as thirty different stringholder mechanism set-ups were needed to handle the various tie materials. Utilization of the herein-disclosed invention, because of its advantageous ability to effectively clamp the twine in limited directions only, has dramatically reduced the requirement for different stringholders to some five basic set-ups.

SUMMARY OF THE INVENTION

There is provided in the present invention an improved twine catcher and knife trap assembly for a package tying machine. The improvement in the twine catcher resides in a slotted operating bearing or aperture in the support structure of the stringholder button that is so angled (relative to oscillations of the stringholder button) as to effect limited movement (laterally of the button's shaft) to the button. Thus, the stringholder button can self-cam or cant over to a more forceful clamping position (against the mating face of the support structure) in a direction generally longitudinally of the slotted hole but is prevented from tilting in the direction generally normal thereto (toward the machine's knotter mechanism). Accordingly, the stringholder button is prevented from excessively clamping down and locking against the twine's original and second clamped end portions during that portion of a package tying operation wherein the knot is being formed and the original twine end is being pulled out from the twine catcher.

Additionally, the cutter and pull out members of the machine's knife trap assembly are so positioned relative to one another as to delay the severing action until the pull out action is completed. That is, the pull out member first dislodges the original twine end before the cutter member severs the second twine end from the tied package thereby desirably releasing the tied package while maintaining a clamped hold on the previous second end as the new original end for the next consecutive cycle. This stepwise procedure of pull out and severing assures that no premature pull out of the second twine end, whether complete or partial, will occur. This, in return, reduces the occurrence of misties and improves the machine's effectiveness.

Thus, it is a principal object of this invention to provide an improved stringholder and knife trap assembly for a package tying machine which decreases the occurrence of misties in a package tying machine and thereby increases the machine's operational efficiency.

It is another object of this invention to provide an improved stringholder mechanism which allows maximal stringholder clamping action in limited desired directions.

It is a further object of this invention to provide an improved knife trap assembly which decreases the possibility of premature pull out of the tie material by effecting stepwise pull out and severing operations.

It is a still further object of this invention to provide an improved stringholder mechanism which can accommodate a much greater range of tie materials than heretofore possible.

The means by which the foregoing and other objects of the present invention are accomplished and the manner of their accomplishment will be readily understood from the following specification upon reference to the accompanying drawings, in which:

FIG. 3 is a front elevational view of the assembly of FIG. 1 showing the tying machine's knotter and wrapper arm apparatus in phantom lines, and further, depicting the stringholder button in different operational positions;

FIG. 4 is an enlarged plan view of the bearing block of the stringholder assembly shown in FIG. 3;

FIG. 5 is a sectional side view of the bearing block of FIG. 4 taken along the line 5—5, and depicting in phantom the associated stringholder button; and FIG. 6 is a fragmentary enlarged view of FIG. 3 depicting the positions of the various twine portions during a tying operation.

DESCRIPTION OF A PREFERRED EMBODIMENT

Figure 1:
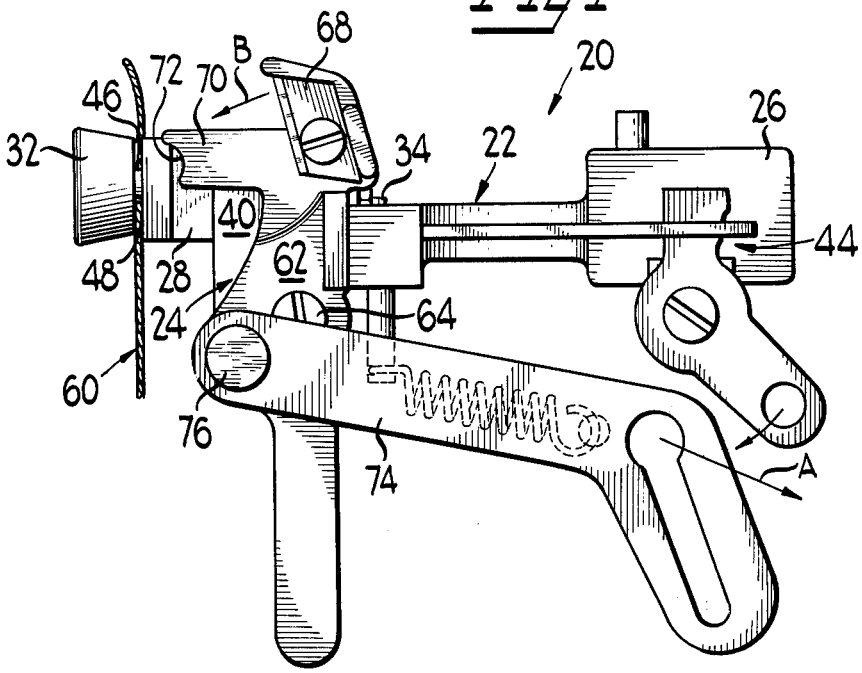
FIG. 1 is a side elevational view of the hereindisclosed stringholder mechanism and knife trap assembly for a package tying machine.
Figure 2:
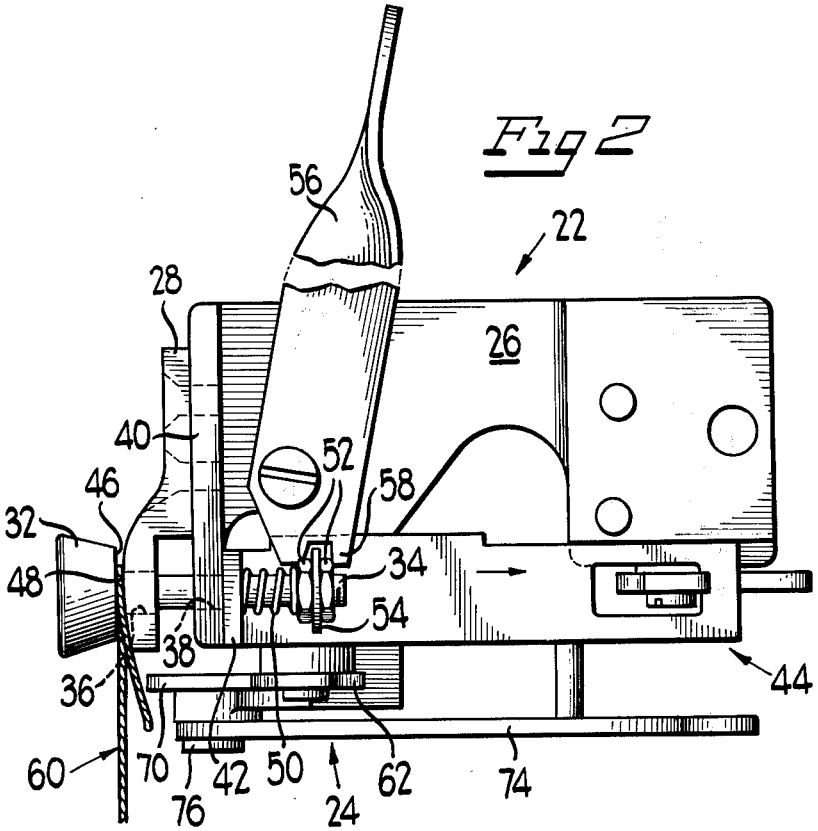
FIG. 2 is a plan view of the assembly of FIG. 1.

Having reference to the drawings, wherein like reference numerals indicate corresponding elements, there is shown in FIG. 1 an illustration of a combination stringholder and knife trap assembly which is generally denoted by reference numeral 20. The assembly 20 is comprised of a stringholder mechanism and a cutter and pull out mechanism which are generally denoted by reference numerals 22, and 24, respectively. As best seen in FIGS. 1, 2, and 3, the stringholder mechanism 22 comprises a metallic mounting block 26 which is rigidly mounted to the frame of a package tying machine (not shown) adjacent the knotter mechanism thereof (the latter is shown in phantom in FIG. 3), a stringholder bearing block 28 which in turn is rigidly mounted, such as by threaded fasteners 30, 30, to mounting block 26, and a stringholder button 32 having a shaft 34 with a shoulder 35. Separate bearing block 28 is preferably formed as a cast metallic piece.

As best seen in FIGS. 2 & 5, the stringholder 32 is mounted for oscillating movement in juxtaposition to blocks 26, 28 through the loose fitting abutment of shoulder 35 of shaft 34 in a slotted or elongated aperture or hole 36 formed in bearing block 28, and through the close fitting support of shaft 34 in a mating hole 38 which is formed in an upstanding lip portion 40 of mounting block 26. The shaft 34 also extends through the upstanding lip portion 42 of the linkage assembly 44, the operation of which is described in detail in U.S. Pat. No. 3,708,190; the latter assembly forms no part of the present invention. For purposes of the present invention it is sufficient to say that the purpose of linkage assembly 44 is to provide two levels of tension to the stringholder. That is, that the stringholder provides a selected tension to the twine for the wrapping cycle of the package tying machine and a somewhat decreased tension during the machine's knotting cycle.

A back face 46 of the stringholder button 32 forceably abuts the bearing face 48 of block 28 due to the fact that shaft 34 is under the axial bias (to the right in FIG. 2) of a compression spring 50 inserted over shaft 34 and bearing at one end against the back side of upstanding lip 42 and at its other end against a pair of nuts 52, 52 having a flat washer 54 carried therebetween. A string-holder release lever 56 is pivotally fastened to mounting block 26 in any well known manner and terminates in a notched nose portion 58 operable to engage flat washer 54 and effect separation of stringholder button 32 from mounting block 26 for purposes of inserting a tie material therebetween, such as twine 60, or for cleaning chaff from therebetween.

The cutter and pull out mechanism 24 is comprised of a carrier member 62 which is pivotally fastened, such as by threaded fastener 64 to a shoulder 66 formed on the underneath side of mounting block 26. A cutter element 68 is rigidly fastened in any well known manner to carrier 62 at the uppermost portion thereof (FIGS. 1 & 3), and an outwardly extending finger 70 has a groove 72 formed therein, the purpose of which will become obvious later herein. An operating lever 74 is pivotally connected by pin 76 to carrier member 62 but is positioned in an offset manner relative to the pivotal movement of carrier 62 about fastener 64. A detailed description of the operation of lever 74 is found in the above-referenced patents concerning package tying machines, however, for purposes of the present invention it is sufficient to note that movement of lever 74 in the direction of arrow A (FIG. 1) causes the carrier member 62 to pivot in the direction of arrow B. Accordingly, as carrier member 62 is rocked counterclockwise (FIG. 1), the cutting element 68 is driven into severing relation with one portion of twine but, because of the relative displacement between cutting element 68 and groove 72, this occurs only after the groove 72 has engaged and operated upon another portion of twine, as will be described later herein.

One of the present invention's improvements in a combination twine catcher and knife trap assembly resides in the stringholder mechanism which will be described presently. The stringholder bearing block 28 (FIGS. 4 & 5) includes a mounting portion 78 having appropriate holes for the fasteners 30, 30 and a bearing portion 80 on which is formed a specially-configured bearing face 48, and through which is formed the advantageous slotted hole 36. As best seen in FIG. 5, the shoulder 35 on shaft 34 is operable to engage the various edge portions of the slotted hole 36 in response to the varying oscillations of button 32. The bearing face 48 is somewhat spiral in configuration so that it represents approximately a convolution of a helix with a small axial advance. This helix starts at an approximate radial shoulder 82 and extends counterclockwise (FIG. 4) with a gradual outward (toward the reader) progression back to the shoulder 82. The height of the shoulder 82 is somewhat less than the minimal diameter of the tie material being employed. The function of the shoulder 82 is to provide a groove in which the original clamped twine end portion can ride and thereby allow the second reach of twine that is caught by the stringholder mechanism 22 to wrap substantially full circle about the shaft 34. (See U.S. Pat. No. 2,274,525 for a more detailed description of the configuration of a bearing face for a typical stringholder button.) So as to prevent the abovenoted chaff and peeling buildup during the stringholder's operation, I have found it advantageous to form a rather large-radiused chamfer on bearing face 48 along one edge portion of hole 36 which is depicted as the shaded area in FIG. 4 denoted by reference letter W.

FIG. 6 illustrates the positions that the various portions of twine taken when under frictional retention at the clamping abutment of button 32 and block 28 and after two reaches of twine have been wrapped about a package (not shown) by the wrapper arm (in the direction of the arrow in FIG. 3) and as the knot (not shown) is being formed by the knotter. FIG. 4 shows that the general angular positioning of slotted hole 36 in bearing block 28 is approximately at a right angle to a line between the hole 36 and the knotter (FIG. 3). (I have found that the most preferable angle — from the horizontal — for the longitudinal alignment of slotted hole 36 is approximately 42°, as shown in FIG. 4.) It will be understood that, because of this angled alignment of slotted hole 36 in relation to the direction of oscillations of stringholder button 32 — in response to the pull of the various twine portions due to the respective actions of the knotter and wrapper arm, the button 32 and thus shaft 34 are allowed to cant over only in a direction generally aligned with the line denoted Y (FIG. 6). This is especially important during the initial startup of a package tying cycle as the wrapping arm goes almost instantaneously to its full rotational speed and a sufficient clamping force by the stringholder mechanism is required to maintain a grasp on the original twine end.

However, the above-noted relative alignment of slotted hole 36 prevents the stringholder button 32 from moving in a direction towards the knotter along the line denoted Z in FIG. 6. Thus, regardless of the additional tension placed on those portions of the twine which are effected by the action of the knotter mechanism, namely twine portions 84 and 86, stringholder button 32 is prevented from self-camming and canting over towards the knotter (along line Z). Button 32 is therefore incapable of excessively clamping and locking the twine portions 84, 86, thereby assuring the formation of a proper knot, and further assuring against any excessive clamping of the original twine end portion 88. Because of this latter point, the normal twine chaff buildup behind the string-holder button is kept to a minimum as there is no tendency for the stringholder button to strip off any twine filaments when the original twine end 88 is dislodged therefrom.

The overall result then of the improved string-holder mechanism disclosed herein is that, while all twine portions are sufficiently frictionally retained by the stringholder button at all times, the twine portion 90 extending from the wrapper arm to the stringholder button is grasped more tightly than those twine reaches or portions 84, 86 extending from the button to the machine's knotter mechanism.

As to the operation of another improvement of the present invention, namely the knife trap assembly, it will be understood that the cutter and pull out mechanism 24 is similar to those used in previous package tying machines but improved in that the cutter blade 68 is mounted on carrier 62 in a position somewhat rearwardly (to the right in FIG. 1) of the pull out groove 72 formed in finger 70. This lateral displacement allows the pull out groove 72 — during its rotation in the direction of arrow B in FIG. 1 — to first engage twine portion 86 (FIG. 6) and thus, substantially completely remove and pull out the original twine tail 88 from behind the stringholder button 32 before any severing action of cutter blade 68 occurs on twine portion 84. In this manner, there is assurance that no premature dislodgement of the subsequently cut twine end (from twine portion 84) will occur while the original twine end portion 88 is being pulled out by the operation of groove 72 on carrier 62.

From the foregoing, it is believed that those skilled in the art will readily appreciate the unique features and advantages of the present invention over previous types of twine catcher and knife trap assemblies for package tying machines. Further, it is to be understood that while the present invention has been described in a relation to a particular preferred embodiment as set forth in the accompanying drawings and as above described, the same nevertheless is susceptible to change, variation and substitution of equivalents without departure from the spirit and scope of this invention. It is therefore intended that the present invention be unrestricted by the foregoing description and drawings except as may appear in the following appended claims.

The embodiments of the invention in which an exclusive property or privilege is claimed are defined as follows:

1. In a package tying machine capable of wrapping and knotting one or more reaches of tie material about a package, including a catcher mechanism for anchoring an initial end portion of the tie material during the wrapping and for receiving and anchoring also a second end portion of the tie material which is beyond the wrapped portion of the tie material, a knotter mechanism to one side of the catcher mechanism operating jointly on the reaches of twine which extend between the catcher mechanism and the wrapped portion to knot them together, and a knife trap assembly for releasing said initial end from the catcher mechanism and for severing said second-anchored of said reaches between the knot and catcher mechanism, leaving the second-anchored portion held by the catcher mechanism as the initial end portion for the succeeding cycle of the machine, the improvement comprising in combination: a stringholder button having a shaft, a bearing block having a configured face for cooperative juxtaposition with the button to frictionally retain the tie material therebetween, and means for urging the button toward the face of the bearing block, said bearing block including a slotted aperture formed therein for receiving said button shaft, whereby the cooperating abutment of said slotted aperture in said bearing block and said button shaft operate to prevent oscillation of said button in a direction toward said knotter mechanism while allowing oscillation of said button in a direction to effect maximal clamping of the tie material during the wrapping thereof.

2. In a package tying machine including a wrapper for placing a tie material about a package to form one or more wraps thereabout, a catcher mechanism for anchoring an initial end of the tie material during the wrapping and for receiving and anchoring also a region of the tie material beyond the wrapping portion of the tie material, a knotter to one side of the catcher mechanism operating jointly on the reaches of tie material which extend between the catcher mechanism and the wrapping portion to knot them together, and means for releasing the initial end from the catcher mechanism and for severing the second-anchored of said reaches between the knot and catcher mechanism, leaving the second-anchored region held by the catcher mechanism as the initial tie material end for the succeeding cycle of the machine, the improvement comprising in combination: a catcher mechanism comprising a button, a shaft therefor, a supporting block having a face for cooperating with the button to receive and retain the tie material therebetween, an elongated bearing in the supporting block for mounting the shaft for axial movement, and spring means urging the button toward the face to clamp the associated tie material, said elongated bearing being aligned along its longer dimension in a direction generally normal to a line between said bearing and said knotter mechanism to prevent the button from canting toward said knotter mechanism against the tension of said spring means thereby to provide a desired clamping of said tie material during the wrapping thereof and to prevent any excessive clamping of said tie material during the formation of the knot.

3. A package tying machine comprising a wrapper for placing a tie material about a package to form one or more wraps thereabout, a catcher mechanism for anchoring an initial end of the tie material during the wrapping and for receiving and anchoring also a second region of the tie material beyond the wrapped portion thereof, a knotter mechanism to one side of the catcher mechanism operating jointly on the reaches of tie material which extend between the catcher mechanism and the wrapped portion to knot them together, and means for releasing the initial end of the tie material from the catcher mechanism and for severing the second-anchored region of tie material at a point between the knot and the catcher mechanism, leaving the second-anchored region held by the catcher mechanism as the original end for the succeeding cycle of the machine, the catcher mechanism comprising a stringholder button, a shaft therefor, a bearing block having a face for cooperating with the stringholder button to receive and retain the tie material therebetween, said bearing block further characterized by having a bearing for mounting the button shaft for axial movement, and spring means urging the stringholder button towards the said face to pinch the tie material therebetween, said bearing being oversized in only one direction so as to prevent the stringholder button from shifting laterally toward the knotter against the tension of the said spring means yet allowing said stringholder button to shift in the direction of wrapping of the tie material.

4. A twine catcher and knife trap assembly for a package tying machine of the type having a wrapper arm and a knotter mechanism operable to wrap and knot one or more reaches of twine about a package, comprising in combination: mounting block means carried by the frame of a package tying machine; bearing block means rigidly mounted said mounting block means and having a slotted operating aperture formed therein; a stringholder button means having shaft means operable to extend through said slotted operating aperture; biasing means connecting said shaft means to said mounting block means and operable to bias said stringholder button means against said bearing block means; carrier means pivotally mounted on said mounting block means and comprising an extended finger portion having groove means formed thereon and cutter means rigidly mounted thereto at a spaced distance relative to said groove means; and means operable to rotate said carrier means, whereby the abutment of said shaft means and said slotted aperture prevents said button means from self-camming in the direction of the associated knotter mechanism, and further, wherein said rotation of said carrier means effects substantially complete dislodgement from said assembly of a first associated twine portion before severing of a second associated twine portion.

5. In a package tying machine including a wrapper for placing one or more reaches of twine about package, a twine catcher for anchoring an initial end of twine and for receiving and anchoring a second portion of twine beyond the wrapped portion, a knotter to one side of the twine catcher and operable to jointly knot the reaches of twine which extend between the twine catcher and the wrapped portion, and a knife trap assembly operable to dislodge the initial twine end and to sever the second-anchored twine portion, the improvement comprising:

carrier means for a knife trap assembly characterized by being pivotally mounted to the frame of the package tying machine; an extending finger portion formed on said carrier and including pull out groove means formed thereon; and cutter blade means rigidly mounted said carrier means at a position sufficiently spaced relative to said pull out groove, whereby when said carrier is rotated said pull out groove means is operable to effect substantially complete dislodgement of an anchored initial twine end from the associated twine catcher before said cutter blade means is operable to sever a second-anchored twine portion.

* * * * *